US007770875B2

(12) United States Patent
Pyron

(10) Patent No.: US 7,770,875 B2
(45) Date of Patent: Aug. 10, 2010

(54) CHAIN VISE PIPE CLAMP

(75) Inventor: Roger Pyron, Arlington, TN (US)

(73) Assignee: Thomas & Betts International, Inc., Wilmington, DE (US)

( * ) Notice: Subject to any disclaimer, the term of this patent is extended or adjusted under 35 U.S.C. 154(b) by 0 days.

(21) Appl. No.: 12/029,744

(22) Filed: Feb. 12, 2008

(65) Prior Publication Data

US 2008/0224377 A1 Sep. 18, 2008

Related U.S. Application Data

(60) Provisional application No. 60/906,983, filed on Mar. 14, 2007.

(51) Int. Cl.
*B25B 5/14* (2006.01)
*B25B 5/16* (2006.01)

(52) U.S. Cl. ..... 269/270; 269/265; 269/43

(58) Field of Classification Search ..... 269/43, 269/268–270, 257, 285, 130–132
See application file for complete search history.

(56) References Cited

U.S. PATENT DOCUMENTS

| | | | | |
|---|---|---|---|---|
| 1,054,664 | A | | 3/1913 | Amborn |
| 1,145,560 | A | | 7/1915 | Corder |
| 1,412,708 | A | | 4/1922 | Richardson |
| 1,824,944 | A | | 9/1931 | Carnelli |
| 1,916,556 | A | | 7/1933 | Butt |
| 2,552,618 | A | | 5/1951 | Boatright |
| 2,720,128 | A | | 10/1955 | Woolley |
| 2,962,919 | A | * | 12/1960 | Grundmann et al. ..... 81/186 |
| 3,205,736 | A | | 9/1965 | Crickmer |
| 3,247,742 | A | | 4/1966 | Woodbury |
| 3,272,038 | A | | 9/1966 | Burstall |
| 3,304,817 | A | | 2/1967 | Swanstrom, Jr. et al. |
| 3,365,762 | A | | 1/1968 | Spiri |
| 3,805,646 | A | | 4/1974 | Knight |
| 4,515,195 | A | * | 5/1985 | Gladstein ..... 144/366 |
| 4,592,682 | A | | 6/1986 | Vanistendael |
| 4,666,138 | A | * | 5/1987 | Dearman ..... 269/43 |
| 5,193,397 | A | | 3/1993 | Hugelier et al. |
| 5,320,021 | A | | 6/1994 | Heintz |
| 6,302,410 | B1 | | 10/2001 | Wentworth et al. |
| 6,382,610 | B1 | | 5/2002 | Corbin |
| 6,651,967 | B1 | * | 11/2003 | Barber ..... 269/43 |
| 6,971,283 | B2 | | 12/2005 | Belik |
| 2008/0224377 | A1 | * | 9/2008 | Pyron ..... 269/270 |

* cited by examiner

*Primary Examiner*—Lee D Wilson
(74) *Attorney, Agent, or Firm*—Hoffmann & Baron, LLP

(57) ABSTRACT

An aspect of the invention is provides a clamping shell for placement about an elongate pipe for accommodating a chain vise thereover, the clamping shell having: a pair of elongate generally arcuate half-shells, each half shell having an internal portion for engagement with the pipe, the internal portion including a non-uniform surface for frictional engagement with the pipe; and at least one of the half-shells of the pair including a pocket formed on an external surface thereof for supporting the chain vise therein.

7 Claims, 3 Drawing Sheets

CHAIN VISE PIPE CLAMP

RELATED APPLICATION

The present application claims the benefit of U.S. Provisional Application No. 60/906,983, filed on Mar. 14, 2007. The aforementioned application is incorporated herein by reference in its entirety.

FIELD OF THE INVENTION

The present invention relates generally to a clamp for placement about an elongate pipe so as to be accommodated in a chain vise. More particularly, the present invention relates to an improved clamping shell including a pair of half-shells which are placed preferably about a PVC pipe to protect the pipe within a chain vise.

BACKGROUND OF THE INVENTION

In many situations where it is necessary to cut, thread, bend or weld an elongate pipe in the field, it is necessary to hold the pipe to prevent rotation during the operation. One tool which is effectively used is a chain vise. As its name implies, the chain vise applies a chain about the pipe so as to clamp the pipe in the vise. Tightening of the chain around the pipe causes frictional engagement therewith so as to prevent movement or rotation of the pipe during the operation.

In certain situations, especially where PVC or other non-metallic pipe is used, the chain vise, by applying tightening pressure directly to the pipe, may have a tendency to damage the surface of the pipe.

In certain situations, especially where PVC or other non-metallic pipe is used, the chain vise, by applying tightening pressure directly to the pipe, may have a tendency to damage the surface of the pipe.

The art has seen the use of half-shell clamps which are placed about the pipe and serve to support the chain of the chain vise. These half-shell clamps prevent direct contact between the chain of the chain vise and the pipe surface. One problem associated with certain half-shell clamps is that the clamps slip with respect to the pipe. Attempts to increase the friction between the half-shell clamps and the pipe, such as placing score marks on the internal surface of the half-shell clamps, result in ineffective gripping power and/or increased damage to the surface of the pipe.

It is, therefore, desirable to provide half-shell clamps for placement about a pipe so as to accommodate a chain of chain vise.

SUMMARY OF THE INVENTION

The present invention provides a clamping shell for placement about an elongate pipe for accommodating a chain vise. The clamping shell includes a pair of elongate generally arcuate half-shells. Each half-shell includes an internal portion for engagement with the pipe. The internal portion of each half-shell includes a non-uniform surface for frictional engagement with the pipe. At least one of the half-shells of the pair includes a pocket formed on an external surface thereof for supporting the chain vise therein.

In a preferred embodiment, the half-shell may also include stiffening ribs on the external surface of thereof. The stiffening ribs may be longitudinally spaced apart so as to define the pocket therebetween.

The internal surface of the half-shells may include a non-uniform pattern formed therein. The non-uniform pattern may take the form of a cross-hatch pattern.

DETAILED DESCRIPTION OF PREFERRED EMBODIMENT

The present invention provides a clamping shell for placement around a pipe so that a chain vise can be applied to the pipe without damage thereto.

Figure 1:
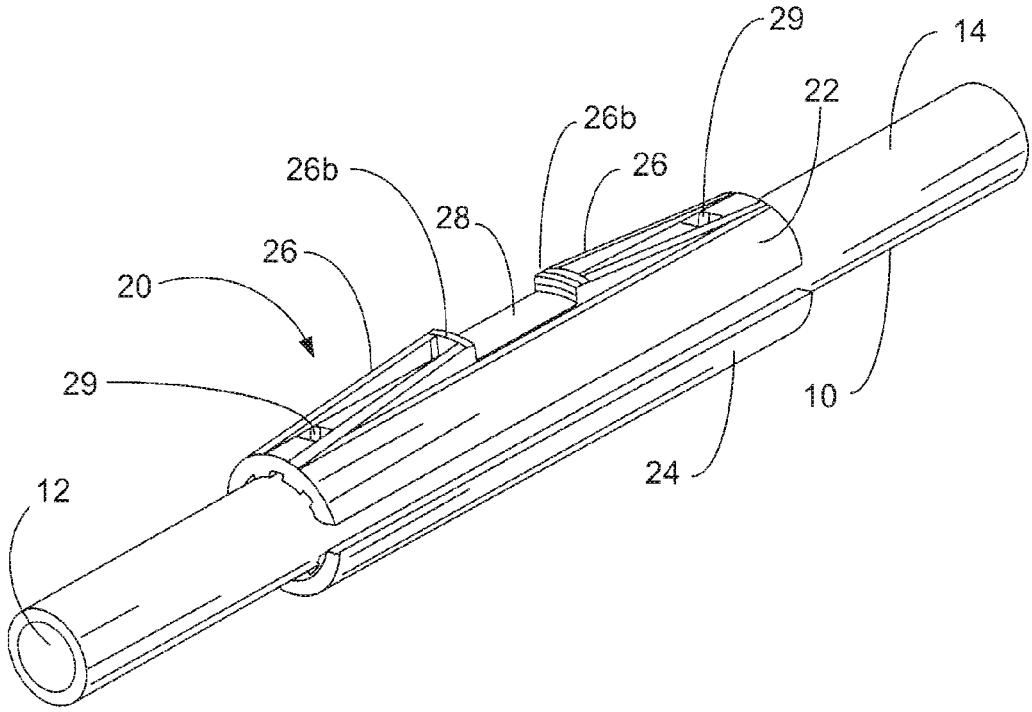
FIG. 1 is a perspective showing of the chain vise pipe clamp of the present invention placed about an elongate pipe.

Referring now to FIG. 1, the present invention may be employed for use on a conventional pipe 10 which is an elongate generally cylindrical member having a hollow inner diameter 12 and a cylindrical outer surface 14. As is well known, it is often necessary to performing work on the pipe such as cutting, threading, or bending the pipe. These operations are typically conducted in the field. In order to hold the pipe in place, a tool known as a chain vise is employed. As its name implies, the chain vise applies a chain around the outer surface 14 of the pipe to secure the pipe. The chain vise holds the pipe in place in as the operation is performed.

Often, the chain itself may cause damage to the pipe during the rotation thereof. Such damage is particularly prevalent when the pipe 10 is formed of a non-metallic material such as PVC. In order to protect the pipe 10 during use of the chain vise, the art has seen the use of clamps which are applied to the outer surface 14 of the pipe 10 and support the chain of the chain vise therearound.

The present invention provides an improved clamp 20 which may be applied around the outer surface 14 of pipe 10 and which supports the chain vise thereover. Clamp 20 includes two clamp shell halves 22 and 24. The clamp shell halves 22 and 24 may include opening 29 thereby. These openings 29 may be use to hang the clamp shell halves for storage.

Figure 2:
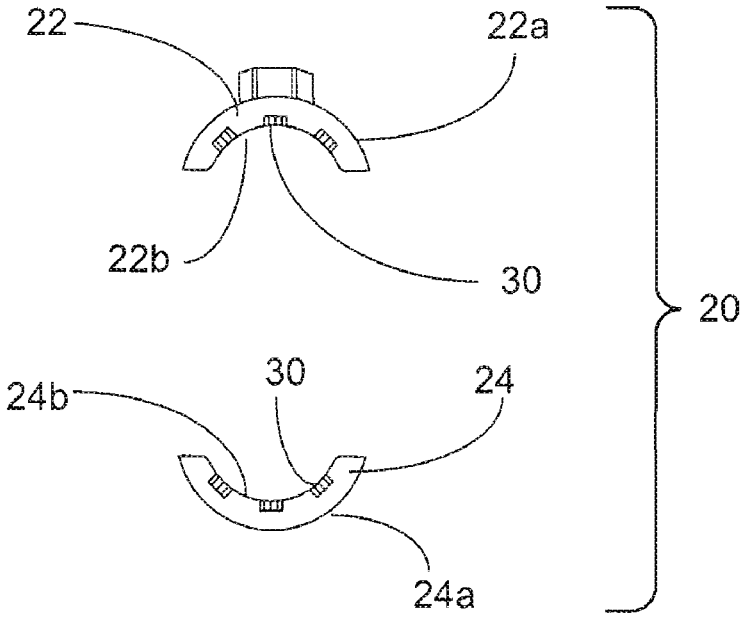
FIGS. 2 and 3 show respectively end and side plan views of the half-shells of the chain pipe clamp of FIG. 1.
Figure 3:
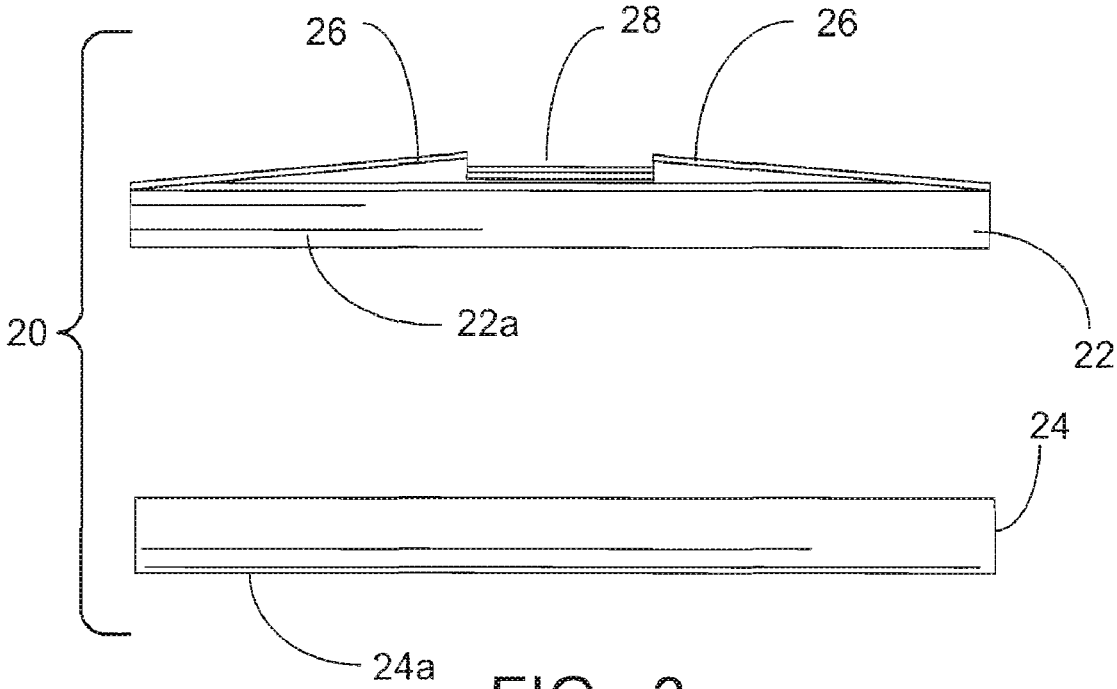

Referring additionally to FIGS. 2 and 3, clamp shell halves 22 and 24 are elongate generally arcuate members formed of a suitable metallic material, preferably cast iron. However, other materials such as aluminum or bronze may be used. Each clamp shell half 22, 24 includes an outer arcuate surface 22*a*, 24*a* and an inner arcuate surface 22*b*, 24*b*. The inner arcuate surface 22*b*, 24*b* has a curved surface which generally matches the outer surface 14 of pipe 10. While the outer surface of clamp shell half 24 is generally uniform, the outer surface of clamp shell half 22 includes thereon a pair of stiffening ribs 26. Each stiffening rib 26 is generally an elongate member extending from one longitudinal end of clamp shell half 22 to a central location. The stiffening ribs are longitudinally spaced apart so as to define a pocket 28 therebetween. The stiffening ribs preferably include a pair of transversely spaced walls which taper upwardly from, the opposed ends of clamp shell half 22 to the central pocket 28. Pocket 28, which is bounded by the upwardly extending transverse walls 26*b* of ribs 26, positionally accommodates and confines the chain of the chain vise preventing lateral movement thereof.

In order to prevent slippage, protect the outer surface 14 of the pipe 10, and improve the frictional engagement of the clamp 20 to the outer surface 14 of the pipe 10, the inner arcuate surfaces 22*b* and 24*b* of clamp shell halves 22 and 24 are formed as frictional engagement surfaces. The inner arcuate surfaces 22*b* and 24*b* may have a non-uniform surface of various forms. In the present illustrative embodiment, the inner surfaces 22*b* and 24*b* are provided with score marks 30 thereon. The score marks 30 take the form of indented channels which provide raised frictional engagement areas for contact with the outer surface 14 of pipe 10. The present invention provides a particularly advantageous score mark 30 pattern on the surfaces 22*b* and 24*b*.

Figure 4:
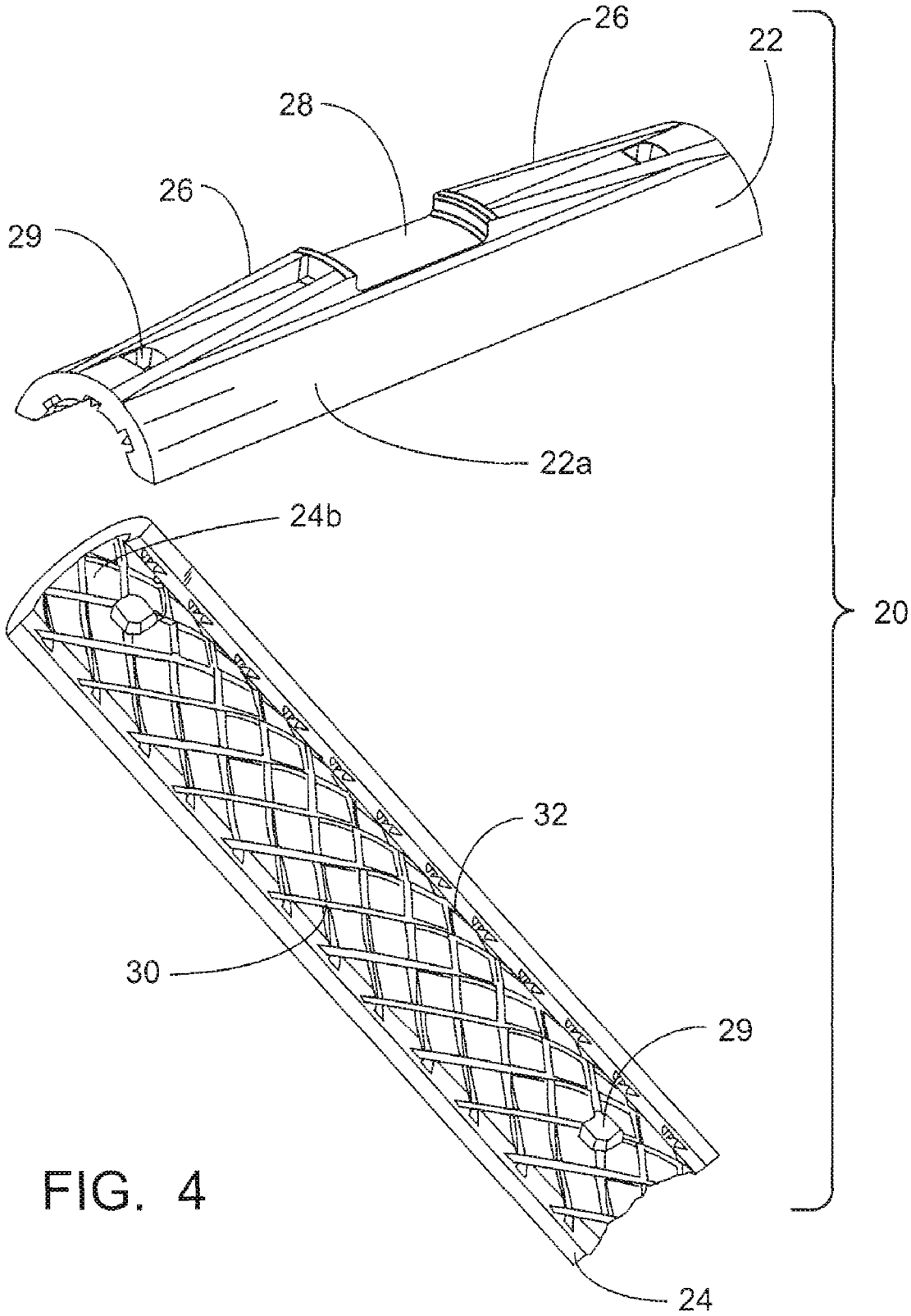
FIG. 4 is a perspective showing the half-shells of the chain vise clamp of FIG. 1.

Referring to FIG. 4, the present invention provides a cross hatch 32 pattern which is in the form intersecting angular lines. The intersecting angular lines of the cross hatch 32 may preferably intersect at a 60° angle. Moreover, the pattern of cross hatch 32 lines are scored to a precise depth, thereby facilitating the gripping of the outer surface 14 of pipe 10 without causing damage thereto. The particular angular cross hatch design shown herein allows for compression around the outer surface 14 of pipe 10 in all directions. The design of the cross hatch 32 pattern is such that as a compressive force is applied to the pipe 10 by the chain vise, the clamp shell halves, 22 and 24, transfer the force across all surfaces in a compression mode, thereby spreading the force evenly across the surface area of the pipe 10. Such an arrangement allows the pipe 10 to be clamped without slippage and without the clamp 20 causing damage to the outer surface 14 of pipe 10.

While the invention has been described in related to the preferred embodiments with several examples, it will be understood by those skilled in the art that various changes may be made without deviating from the fundamental nature and scope of the invention as defined in the appended claims.

What is claimed is:

1. A clamping shell for placement about an elongate pipe for accommodating a chain vise thereover, said clamping shell comprising:

a pair of elongate generally arcuate half-shells, each half shell having an internal portion for engagement with said pipe, said internal portion including a non-uniform surface including a scored pattern for frictional engagement with said pipe, said scored pattern allowing for gripping of the pipe without damage thereto;

at least one of said half-shells of said pair including a pocket formed on an external surface thereof for supporting said chain vise therein;

said external surface of said one half-shell including elongate stiffening ribs; and wherein said stiffening ribs are elongate and longitudinally spaced and wherein said space between said ribs defines said pocket.

2. A clamping shell of claim 1 wherein said elongate stiffening ribs have a tapered height extending from the external surface of said one half shell.

3. A clamping shell of claim 2 wherein said stiffening ribs taper downward from a central space apart location.

4. A clamping shell of claim 3 wherein said spaced apart location defines said pocket.

5. A clamping shell for placement about an elongate pipe for accommodating a chain vise thereover, said clamping shell comprising:

a pair of elongate generally arcuate half-shells, each half shell having an internal portion for engagement with said pipe, said internal portion including a non-uniform surface including a scored pattern for frictional engagement with said pipe, said scored pattern allowing for gripping of the pipe without damage thereto;

at least one of said half-shells of said pair including a pocket formed on an external surface thereof for supporting said chain vise therein;

wherein said non-uniform internal surface of half-shells are defined by a depression pattern in said internal surface.

6. A clamping shell of claim 5 wherein said depression patterns is a cross-hatch.

7. A clamping shell of claim 6 wherein said cross-hatch pattern is a 60° cross-hatch pattern.

* * * * *